US007057567B2

(12) United States Patent
Koch

(10) Patent No.: US 7,057,567 B2
(45) Date of Patent: Jun. 6, 2006

(54) PROJECTILE COMPRISING A RECEPTION ANTENNA FOR A SATELLITE NAVIGATION RECEIVER

(75) Inventor: Volker Koch, Rückersdorf (DE)

(73) Assignee: Diehl Munitionssysteme GmbH & Co., Röthenbach (DE)

( * ) Notice: Subject to any disclaimer, the term of this patent is extended or adjusted under 35 U.S.C. 154(b) by 114 days.

(21) Appl. No.: 10/491,594

(22) PCT Filed: Oct. 4, 2001

(86) PCT No.: PCT/EP01/11463

§ 371 (c)(1),
(2), (4) Date: Apr. 1, 2004

(87) PCT Pub. No.: WO03/032435

PCT Pub. Date: Apr. 17, 2003

(65) Prior Publication Data

US 2005/0078036 A1 Apr. 14, 2005

(51) Int. Cl.
*H01Q 1/28* (2006.01)

(52) U.S. Cl. ..... 343/708; 343/700 MS; 343/705

(58) Field of Classification Search ..... 343/700 MS, 343/705, 708; 102/214, 384; 244/3.14, 244/3.21

See application file for complete search history.

(56) References Cited

U.S. PATENT DOCUMENTS

| | | | | |
|---|---|---|---|---|
| 3,943,520 | A | 3/1976 | Apstein et al. | 343/708 |
| 4,305,078 | A | 12/1981 | Jones, Jr. et al. | 343/708 |
| 4,410,891 | A | 10/1983 | Schaubert et al. | 343/700 MS |
| 5,400,040 | A | 3/1995 | Lane et al. | 343/700 MS |
| 6,020,854 | A * | 2/2000 | Jagnow et al. | 343/705 |
| 6,098,547 | A * | 8/2000 | West | 102/214 |
| 6,150,974 | A | 11/2000 | Tasaka et al. | 342/53 |
| 6,307,514 | B1 * | 10/2001 | West | 343/705 |
| 6,615,734 | B1 * | 9/2003 | Koch et al. | 102/213 |

FOREIGN PATENT DOCUMENTS

| | | |
|---|---|---|
| DE | 2408578 C2 | 6/1985 |
| DE | 3544092 A1 | 6/1987 |
| EP | 0 840 393 A2 | 5/1998 |

* cited by examiner

*Primary Examiner*—Hoang V. Nguyen
(74) *Attorney, Agent, or Firm*—Scully, Scott, Murphy & Presser

(57) ABSTRACT

A projectile (12) carries a combination antenna (21), whose tuning corresponds to both the fundamental frequency of the radar (17) of a proximity fuse and the third harmonic of the carrier frequency of a satellite navigation receiver (20), in its replaceable tip (11) under its ballistic radome hood (14), so that both systems may be operated via this one combination antenna (21). For the decoupling, the radar range finder (18) is only put into operation when the navigation receiver (20) has been switched off because the projectile (12) has arrived over the target area on its corrected flight path.

4 Claims, 1 Drawing Sheet

PROJECTILE COMPRISING A RECEPTION ANTENNA FOR A SATELLITE NAVIGATION RECEIVER

This application is a 371 of PCT/EP01/11463 dated 4 Oct. 2001.

BACKGROUND OF THE INVENTION

1. Field of the Invention

The present invention relates to an artillery projectile fuse equipped with a dielectric antenna in the form of a carrier disk, which is installed in a hood of the projectile fuse transversely of the rotational longitudinal axis thereof, and which is electrically conductive and laminated geometrically differently on both sides thereof.

2. Discussion of Prior Art

A fuse equipped in that manner is generally known from the disclosure of U.S. Pat. No. 6,098,547 A.

Therein, a receiving circuit in the base of the fuse, which is shaped like a truncated cone, is connected along its axis via a coaxial cable to a dielectric disk antenna, which is installed in the fuse concentrically and transversely to the lengthwise axis in front of the receiving circuit in the flight direction. The disk antenna is in turn a circumferential slot antenna, transverse to the axis, for navigation and telemetry frequencies, having inductive tuning of bandwidths and mid-band frequencies via electrically conductive channels, whose axes are parallel, between the electrically conductive laminations of the dielectric disk on both sides. The transverse emission of its antenna characteristic is also encouraged in that the dielectric disk extends out into the outer lateral surface of the fuse hood and only the front covering of the disk maintains a small radial spacing from the hood. Such an antenna orientation transverse to the flight direction is expedient for radio links to the hemisphere; however, it is not suitable for a range measurement to the front in the flight direction, as would be necessary for fuse triggering upon reaching a predetermined remaining range to an object or above ground. Using such a single-layered disk antenna, resonance frequencies which deviate strongly from one another also cannot be generated, because of which the telemetry frequencies are to be selected in the same order of magnitude due to the externally predetermined carrier frequencies of the navigation satellites. This complicates undisturbed transmission and analysis of this information, which varies greatly per se, whose transmission and processing in significantly different frequency bands would be preferable.

A similar multifrequency antenna is known from U.S. Pat. No. 4,305,078 A, with the characteristic therein that multiple inductively tunable disk antennas of this type are positioned one on top of another like a sandwich and electrically connected in series as a transversely-emitting slot antenna.

A missile having a multisensor target control, which has a combination of an infrared detector and radar detector, is known from U.S. Pat. No. 6,150,974 A. For a disk antenna that which emits frontally because of its only localized covering, a dielectric material transparent to infrared radiation is selected so that in the region of the missile tip, the infrared detector may be positioned behind the disk antenna, which is installed coaxially and transversely to the lengthwise axis, in the flight direction.

According to DE 24 08 578 A1, a dielectric disk antenna usable both for telemetry tasks and as a ranged fuse, having the same frequency range for both tasks, has a square electrode covering on each side of the disk, the smaller of which has an edge length approximately equal to half of the average operating wavelength of the antenna. Since tuning for the two different tasks is performed via asymmetrical recesses in the smaller electrode surface, an omnidirectionally uniform antenna characteristic does not result, through which reception of amplitude-modulated information in the rotating projectile is decisively interfered with.

U.S. Pat. No. 6,943,520 A describes a dielectric disk antenna, which is capacitively tunable in the peak range of the power supply, in the form of a triangular dielectric disk which is fitted in the fuse tip along the fuse lengthwise axis.

For the artillery rocket according to EP 0 840 393 8, a dielectric carrier substrate is provided on the outer lateral surface of its fuselage for electrically conductive areas which are coupled to one another thereon and which are laid out as the antenna structure for the carrier frequency of navigation satellites. As much as these lateral surface antenna as have already proven themselves for receiving satellite location information, they nonetheless have the disadvantage of not being able to be applied to the projectile—particularly as retrofitting—without problems in regard to the mechanical strain when being fired from a barrel.

SUMMARY OF THE INVENTION

The present invention is based on the technical object of refining a fuse equipped according to the species in such a way that, because of a small-scale multifrequency antenna for greatly varying frequency ranges such as satellite navigation and proximity fuse triggering, it is usable in the tight space of the fuse tip in addition to the installed fuse equipment in manifold ways and nonetheless with functional reliability.

This object is achieved according to the present invention as described by the feature combination of the main claim essentially in that a dielectric antenna which is positioned inside the fuse ogive and laid out in front for frontal emission is operated using a radar range finder frequency which is in the magnitude of the third harmonic of an available satellite carrier frequency, with this antenna optionally usable initially for navigation tasks and, towards the end of the mission, only then for the proximity measurement for fuse triggering instead.

This object is achieved according to the present invention, as shown in the features in the characterizing part of the main claim, for a projectile according to the species essentially in that the antenna is laid under its ogive, where the electrically conductive areas are applied on both sides of a dielectric carrier disk position concentrically and transversely to the lengthwise axis of the projectile.

The tip of a modern artillery projectile typically contains, in the flight direction, behind a concentrically positioned programming coil, a circuitry module having at least one signal processor for the analysis electronics, and behind this safety and trigger devices. Since the tip is screwed onto the fuselage of the projectile, in order to first apply it in case of use, it is also replaceable without problems. It has been shown that in the inner space of the tip, which tapers toward the front, there is still free space directly in front of the coil for the additional installation of the carrier disk for the antenna structure of the navigation receiver. The receiver itself, i.e., the signal processing for obtaining and analyzing the satellite navigation information, may be included in the module placed behind the coil.

The antenna structure, i.e., the geometry of the electrically conductive areas on both sides of the dielectric carrier disk, is preferably laid out in relation to the axis of rotation of the projectile in such a way that a point-symmetric antenna diagram results, in order to avoid rotation-dependent interfering influences, such as amplitude modulations of the signals received in particular, as much as possible.

The concept of shifting the navigation receiving antenna from the lateral surface of the projectile into the inside the projectile tip may be problematic, however, if the tip is already equipped, for a modern artillery fuse, as in the case of the established multifunction fuse DM74, with a coaxial dipole or helix radar antenna in front of the programming coil for the proximity trigger criterion, which results in spatial and electrical restrictions in the antenna functions. According to a refinement of the present invention, this problem is overcome, however, in that the navigation antenna is laid out for the third harmonic of the satellite carrier frequency and therefore for the magnitude of the carrier frequency of a typical radar range finder. The additional radar dipole antenna is then unnecessary, and the flat cylindrical disk-shaped antenna structure is used by both systems (navigation receiver and radar range finder) as an antenna system. However, it is now expedient to perform decoupling to avoid mutual interference, which is performed most simply by not operating the navigation receiver and the radar simultaneously. This may be implemented without problems, because the satellite navigation is only necessary for path measurement (for path correction), while the radar only has to operate subsequently, after arrival over the target area during the descent to the proximity triggering above ground.

Therefore, with a high degree of integration, GPS receiving is made possible in a radar proximity fuse via frequency coupling, without space for separate antennas being necessary, i.e., the navigation information and the radar echo are obtainable in the tightest space using the same antenna.

Additional refinements and further advantages of the present invention result from the further claims and the following description of an exemplary embodiment of the achievement of the object according to the present invention, shown schematically in the drawing with restriction to the elements essential for the function and not entirely to scale. In the drawing:

DETAILED DESCRIPTION OF THE INVENTION

Figure 1:
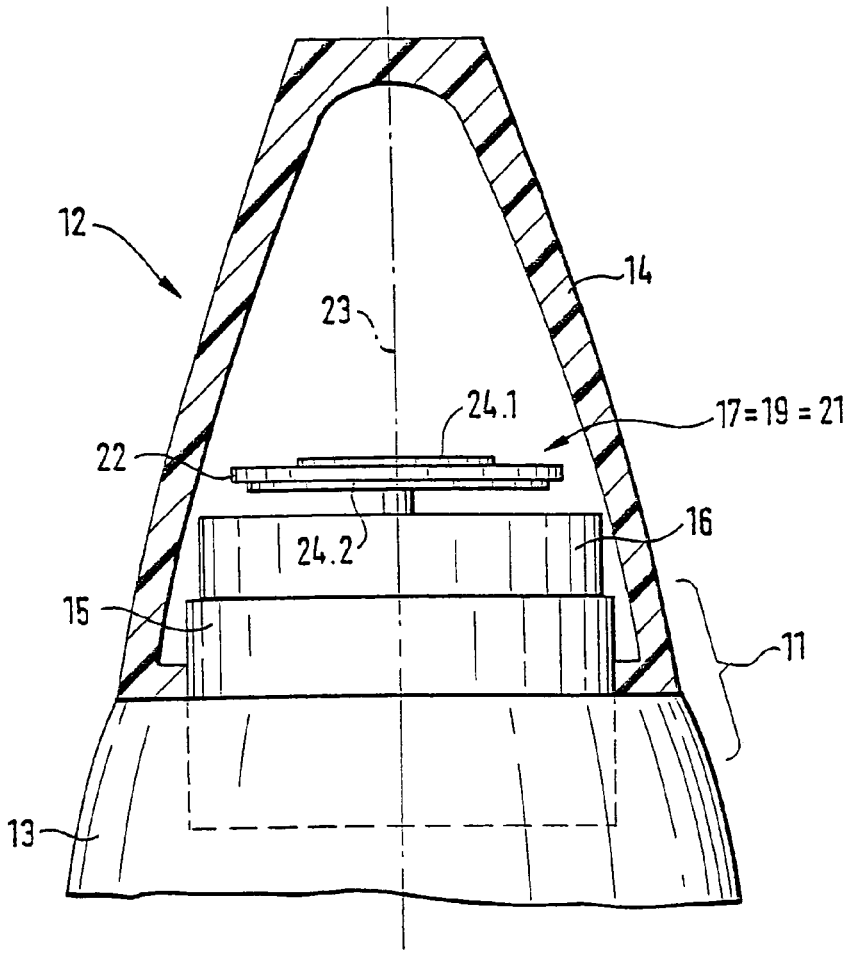
FIG. 1 shows the installation of a combined navigation and radar antenna in front of the programming coil of a modern artillery fuse and FIG. 2 shows a simplified block diagram of the principle of the decoupling between the navigation receiver and proximity radar through offset mutual operation according to the present invention.

The tip 11 of an artillery projectile 12, shown in FIG. 1 in a truncated illustration and partially in axial longitudinal section, carries a ballistic hood 14 in the form of a plastic radome, transparent to high frequencies, made of a thermoplastic material such as Teflon, in front of its metallic housing 13. The plane of the partition line between housing 13 and hod 14 is penetrated by the circuitry module 15 for different signal processing tasks, which carries a large-area programming coil 16 for the trigger function of the circuit module 15 in front under the radome hood 14 in the projectile flight direction. In the inside of the hood 14, which is shaped like a hollow cone, the dipole or helix structure of the transmitting/receiving antenna 17 of a proximity radar 18 (FIG. 2) is positioned in front of the programming coil 16. This radar antenna 17 is now, however, implemented concentrically in front of the programming coil 16 as a dual mode planar antenna, since it is used simultaneously as the receiving antenna 19 of a satellite navigation receiver 20. The radar antenna 17 and the navigation antenna 20 are therefore combined into a combination antenna 21 on an approximately 2.5 mm thick disk (with a diameter approximately 10 times this), whose lamination is tuned for resonance at the radar frequency in the C band lying between 4 GHz and 5 GHz. Therefore, it is simultaneously tuned to the third harmonic of the L1 carrier frequency of satellite navigation lying at 1.5 MHz, so that the combination antenna 21 is simultaneously optimized for both operation of the radar 18 and operation of the navigation receiver 20.

The combination antenna 21 is constructed as a dielectric flat antenna having electrically conductive planar structures, which are etched out of an originally surface-covering lamination, for example, on each of the two diametrically opposing surfaces of a dielectric carrier disk 22 (shown exaggeratedly thick in the figure for illustration), shaped like a circular disk, for example. The disk lamination includes a front area 24.1 and a rear area 24.2, which extends in all directions beyond its delimitation. To implement an antenna characteristic which is symmetrical to the projectile axis 23, the carrier disk 22 is mounted concentrically and transversely to the axis 23 in front of the programming coil 16.

Figure 2:
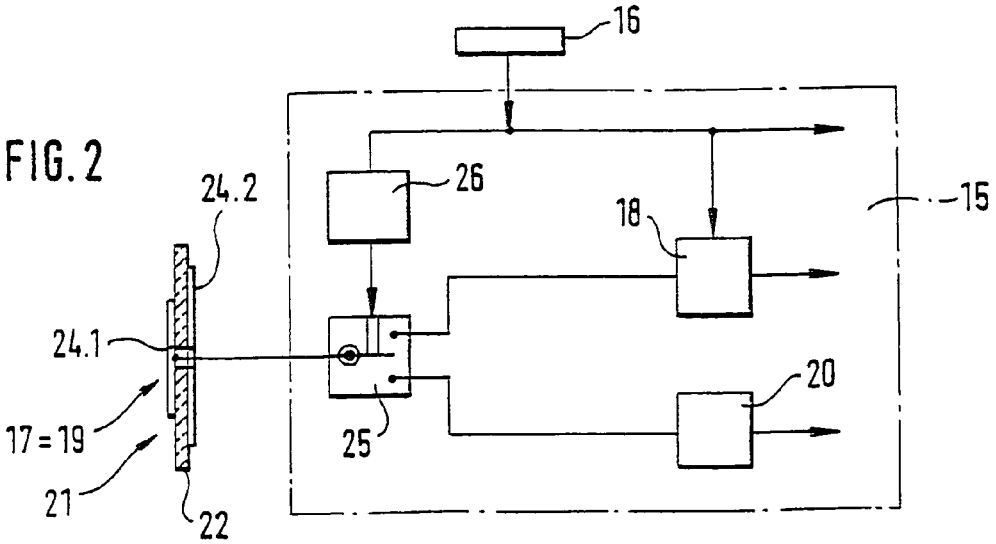

In order to decouple the operation of the proximity radar 18 for the fuse triggering and that of the navigation receiver 20 for the path correction from one another, the combination antenna 21 feeds either the radar 18 or the navigation receiver 20, but not both simultaneously, which is symbolized in FIG. 2 by a changeover switch 25, preferably implemented as a PIN diode switch in interest of the least possible signal loss. This changeover is performed from a control stage 26 only in the final phase of the mission, i.e., after a minimum flight time which may be preset, according to the programming of the use of the radar operation preset via the inductive interface on the coil 16. Until the use of the radar operation, i.e., on the travel flight path, in contrast, the navigation receiver 20 is connected to the combination antenna 21, in order to be able to receive the current flight path with the aid of the satellite navigation or correct it if necessary.

Therefore, the projectile 12 equipped according to the present invention carries an easily integratable combination antenna 21 having hemispherical sight forward in the flight direction in its replaceable tip 11 under its ballistic radome hood 14, whose tuning corresponds to both the fundamental frequency of the radar 17 of a proximity fuse and the third harmonic of the carrier frequency of a satellite navigation receiver 20, so that both systems may be operated in the tightest space via this combination antenna 21. For the decoupling, the proximity radar 18 is only put into operation when the navigation receiver 20 has been switched off, because the projectile 12 has come over the target area on its corrected flight path.

What is claimed is:

1. An artillery projectile fuse having a hood (14), a dielectric antenna (17) installed in said hood (14) extending transversely to a rotational longitudinal axis (23) of said fuse, said antenna being in the form of a dielectric carrier disk (22) which is electrically conductive and laminated in geometrically different areas on both sides of said disk, characterized in that, with the laminated areas (24) of the antenna (21) being laid out point-symmetrical relative to the longitudinal axis (23) for the frequency of a radar range finder at the third harmonic of a navigation satellite carrier frequency, the carrier disk (22) is positioned under the fuse hood (14) with the area (24.2) of a rear disk lamination of said areas (24) projecting in all directions beyond the confines of the front area (24.1), so as to produce an antenna (21) combined from a navigation antenna (19) and a radar antenna (17), having a hemispherical sight oriented forward in the flight direction of said fuse, wherein said combination antenna (21) is switchable alternately to a navigation receiver (20) or to a radar range finder (18) via a changeover switch (25).

2. The fuse according to claim 1, characterized in that said combination antenna (21) is initially operable for a satellite navigation receiver (2) for path measurement for effectuating a path correction and subsequently operable for the radar range finder for effectuating a proximity triggering above ground.

3. The fuse according to claim 1, characterized in that a control stage (26), which is programmable to different times of use of the radar operation via a coil (16), is connected downstream of the changeover switch (25).

4. The fuse according to claim 3, characterized in that said fuse is equipped behind the carrier disk (21) in the flight direction with a programming coil (16) for behavioral control thereof.

* * * * *